US006449992B1

(12) United States Patent
Yu et al.

(10) Patent No.: US 6,449,992 B1
(45) Date of Patent: Sep. 17, 2002

(54) COMBINATION LOCK DEVICE

(76) Inventors: Chun Te Yu, 41-21, Guan Tso Street, Fu Shing, Changhwa (TW), 506; Ming Chang Shih, No. 3, Lane 438, Minsheng Rd., Changhwa City (TW), 500

( * ) Notice: Subject to any disclaimer, the term of this patent is extended or adjusted under 35 U.S.C. 154(b) by 0 days.

(21) Appl. No.: 09/917,627

(22) Filed: Jul. 31, 2001

(51) Int. Cl.[7] ..... E05B 73/00
(52) U.S. Cl. ..... 70/58; 70/23; 70/28; 70/426
(58) Field of Search ..... 70/22–24, 27–29, 70/58, 25, 424, 425, 426

(56) References Cited

U.S. PATENT DOCUMENTS

| | | | | | |
|---|---|---|---|---|---|
| 442,778 | A | * | 12/1890 | Metzger | 70/426 |
| 942,537 | A | * | 12/1909 | Batdorf | |
| 5,791,171 | A | * | 8/1998 | Kelley | 70/58 |
| 5,970,755 | A | * | 10/1999 | Appelbaum | 70/28 |
| 5,983,679 | A | * | 11/1999 | Reyes | 70/58 |
| 6,058,744 | A | * | 5/2000 | Ling | 70/58 X |
| 6,155,088 | A | * | 12/2000 | Murray, Jr. et al. | 70/58 |
| 6,199,413 | B1 | * | 3/2001 | McDaid et al. | 70/58 |
| 6,212,918 | B1 | * | 4/2001 | Krartin | 70/58 X |
| 6,257,029 | B1 | * | 7/2001 | Liao | 72/58 |
| 6,301,940 | B1 | * | 10/2001 | Derman et al. | 70/14 X |
| 6,317,936 | B1 | * | 11/2001 | McDaid et al. | 70/58 X |
| 6,321,579 | B1 | * | 11/2001 | Reyes | 70/58 |

FOREIGN PATENT DOCUMENTS

| | | | | |
|---|---|---|---|---|
| CA | 454901 | * | 3/1949 | 70/424 |
| DE | 381403 | * | 9/1923 | 70/424 |
| GB | 23674 | * | 10/1906 | 70/424 |

* cited by examiner

*Primary Examiner*—Lloyd A. Gall
(74) *Attorney, Agent, or Firm*—Troxell Law Office PLLC

(57) ABSTRACT

A combination lock device includes a lock body, a lock snap structure locked in a lock hole of an article to be locked, and a drive structure for driving the lock snap structure. The lock snap structure includes a carrier, a first locking plate, and a second locking plate. The first locking plate is pivotally mounted in the carrier and may be vertically pivoted by the drive structure. The second locking plate may horizontally slide and displace relative to the first locking plate when the first locking plate is pivoted. The first locking plate has an end portion provided with a locking tongue portion. The second locking plate has an end portion provided with a resting snap portion. The locking tongue portion is vertical to the resting snap portion.

3 Claims, 9 Drawing Sheets

COMBINATION LOCK DEVICE

BACKGROUND OF THE INVENTION

1. Field of the Invention

The present invention relates to a combination lock device, and more particularly to a combination lock device that may be used to lock a portable article such as a notebook computer or the like.

2. Description of the Related Art

The closest prior art of which the applicant is aware is disclosed in the Taiwanese Patent Publication No. 326850, which discloses a lock snap structure having a locking plate.

Another closest prior art of which the applicant is aware is disclosed in the Taiwanese Patent Publication No. 370147, which discloses a lock snap structure having multiple locking plates.

However, the size of the locking plate cannot be made very large due to limitation of the lock hole of the article to be locked, so that the contact area between the locking plate and the lock hole is very small, thereby causing a stress concentration, so that the snap locking strength of the locking plate is not large enough, and so that the lock hole is easily torn or broken. In addition, two mating locking plates are opposite to each other, so that when the lock body is driven, the two opposite locking plates may provide a support to each other. Thus, the lock hole is easily broken.

SUMMARY OF THE INVENTION

The primary objective of the present invention is to provide a combination lock device that may provide two locking positions that are vertical to each other.

Another objective of the present invention is to provide a combination lock device that may efficiently provide an anti-theft effect.

In accordance with the present invention, there is provided a combination lock device, comprising a lock body, a lock snap structure locked in a lock hole of an article to be locked, and a drive structure for driving the lock snap structure, wherein:

the lock snap structure includes a carrier, a first locking plate, and a second locking plate, the first locking plate is pivotally mounted in the carrier and may be vertically pivoted by the drive structure, the second locking plate is located beside the first locking plate, and may horizontally slide and displace relative to the first locking plate when the first locking plate is pivoted, the first locking plate has an end portion provided with a locking tongue portion toward a direction of movement thereof, the second locking plate has an end portion provided with a resting snap portion toward a direction of movement thereof, the locking tongue portion is vertical to the resting snap portion.

The carrier may be a pivot housing pivotally on the lock body. The pivot housing is formed with an elongated guide slot for passage of a guide rod which is passed through the first locking plate. A pivot rod is passed through the pivot housing for pivoting the first locking plate and the second locking plate. The pivot rod is respectively provided with a torsion spring and a restoring spring on an outside of the first locking plate and the second locking plate, so that the first locking plate may be pivoted to return to an original position by the torsion spring, and the second locking plate can return to an original position by the restoring spring. Two compression springs are mounted in the pivot housing and urged on the guide rod for providing a restoring effect. The first locking plate is formed with bosses, and the second locking plate is formed with mating dimples. The second locking plate is formed with a protruding push portion, such that when the first locking plate is rotated, the second locking plate may be pushed to displace outward relative to the first locking plate by the bosses and the push portion.

The lock body may be a number lock which includes a number wheel structure, and two wheel housings mounted on the number wheel structure. The number wheel structure includes an operation bar which is formed with an oblique guide block, and has a free end formed with a resting block which defines a retaining recess for insertion of a retaining portion of the first locking plate. One wheel housing is formed with a through slot for pivoting a press member which has an arcuate side portion rested on the oblique guide block, so that when the press member is pressed inward, the arcuate side portion may press the oblique guide block so that the operation bar may be retracted inward. Each of the two wheel housings has an outer periphery having a front end formed with a corresponding annular pivot groove, for pivoting an annular pivot snap of a cable. Each of the two wheel housings has an inner periphery formed with an annular flange mating with an annular groove of each of the two pivot housings, and formed with a locking flange for pivoting a mating lip of a push sleeve of the drive structure.

Further benefits and advantages of the present invention will become apparent after a careful reading of the detailed description with appropriate reference to the accompanying drawings.

DETAILED DESCRIPTION OF THE INVENTION

Figure 1:
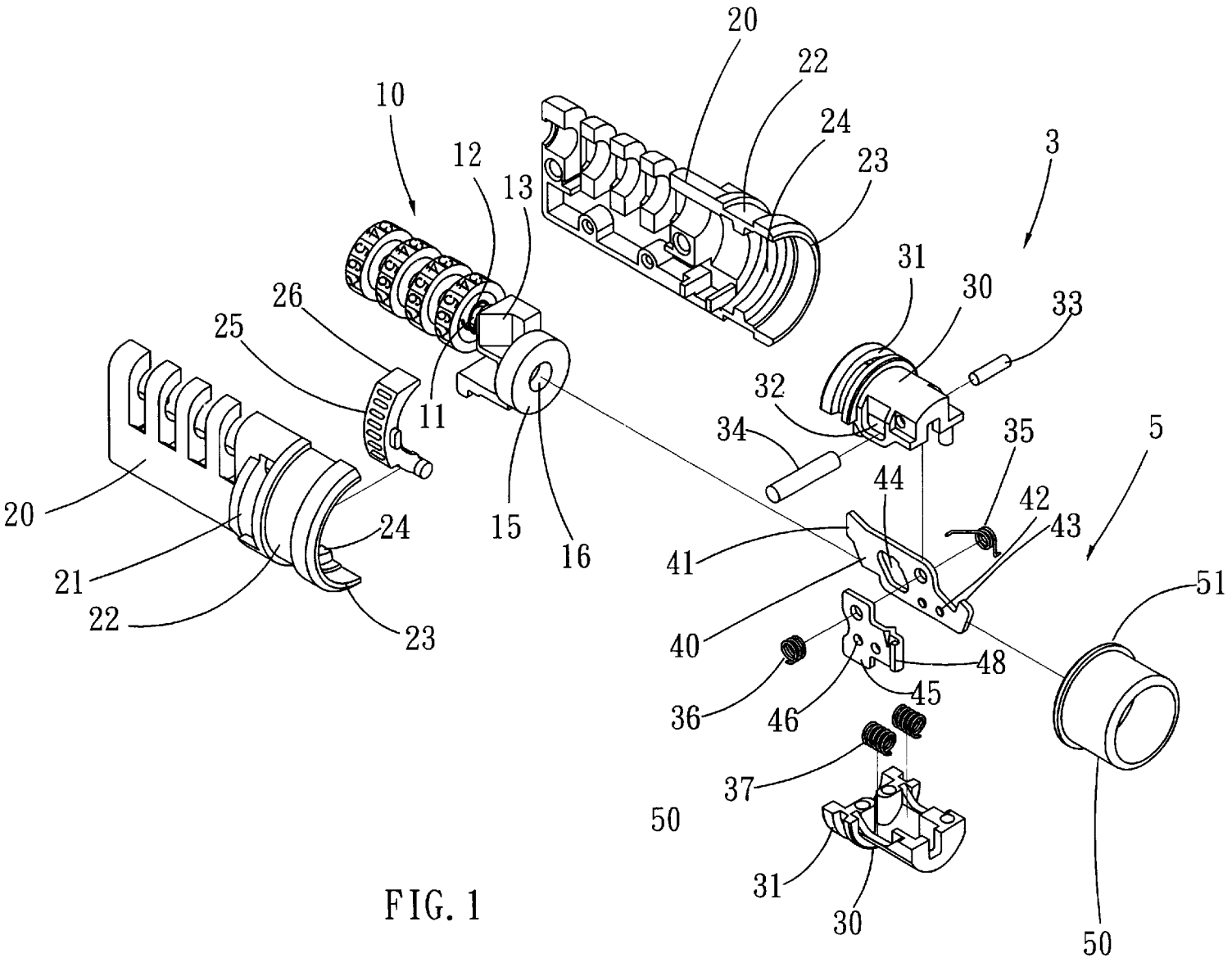
FIG. 1 is an exploded perspective view of a combination lock device in accordance with the present invention.
Figure 2:
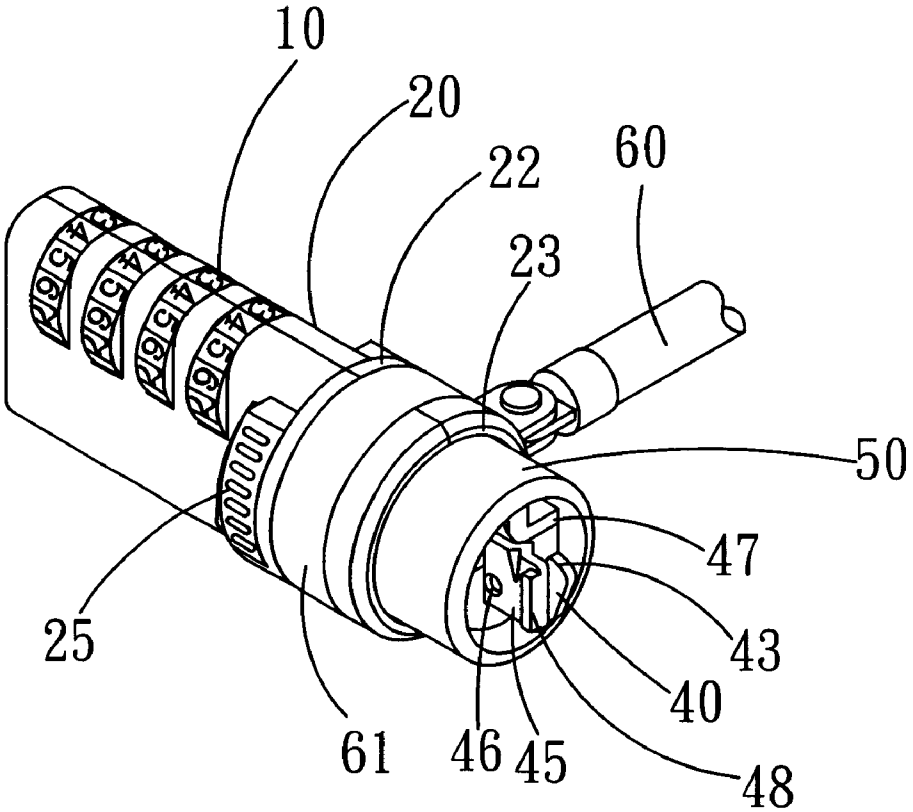
FIG. 2 is a perspective assembly view of the combination lock device as shown in FIG. 1.

Referring to the drawings and initially to FIGS. 1–4, a combination lock device in accordance with the preferred embodiment of the present invention can be adapted to function as a computer lock, and comprises a lock body (or number lock), a lock snap structure 3 mounted in a space of a front section of the number lock, and a drive structure 5 for driving the lock snap structure 3.

The number lock (or lock body) includes a number wheel structure 10, and two wheel housings 20 mounted on the number wheel structure 10. The number wheel structure 10 includes number wheels, an operation bar 11, and a restoring spring 12. When the number wheels of the number wheel structure 10 are rotated to reach the correct positions, the operation bar 11 may co-operate with the restoring spring 12 to elastically retract in the number wheels.

The operation bar 11 is formed with an oblique guide block 13, and has a free end formed with a resting block 15 which defines a retaining recess 16. One wheel housing 20 is formed with a through slot 21 for pivoting a press member 25 which has an arcuate side portion 26 rested on the oblique guide block 13, so that when the press member 25 is pressed inward, the arcuate side portion 26 may press the oblique guide block 13 so that the operation bar 11 may be retracted inward (see FIG. 7).

Each of the two wheel housings 20 has an outer periphery having a front end formed with a corresponding annular pivot groove 22, for pivoting an annular pivot snap 61 of a cable 60. Each of the two wheel housings 20 has an inner periphery formed with an annular flange 24 for pivoting the lock snap structure 3, and formed with a locking flange 23 for locking the drive structure 5.

The lock snap structure 3 includes two pivot housings (or carriers) 30, a first locking plate 40, and a second locking plate 45. Each of the two pivot housings 30 has an outer periphery formed with an annular groove 31 for pivotal insertion of the annular flange 24 of the wheel housing 20.

One pivot housing (or carrier) 30 is formed with an elongated guide slot 32 for passage of a guide rod 34 which is passed through the first locking plate 40, and a pivot rod 33 is passed through the pivot housing 30 for pivoting the first locking plate 40 and the second locking plate 45. The pivot rod 33 is respectively provided with a torsion spring 35 and a restoring spring 36 (see FIG. 4) on the outside of the first locking plate 40 and the second locking plate 45, so that the first locking plate 40 may be pivoted to return to the original position by the torsion spring 35, and the second locking plate 45 can return horizontally to the original position by means of the restoring spring 36. Two compression springs 37 are mounted in the pivot housing 30 and urged on the guide rod 34 for providing a restoring effect.

The first locking plate 40 and the second locking plate 45 mounted on the pivot rod 33 may be used to lock in a lock hole of an article to be locked. The first locking plate 40 may be pivoted on the pivot rod 33, and the second locking plate 45 may be displaced on the pivot rod 33. The first locking plate 40 is formed with bosses 42, and the second locking plate 45 is formed with mating dimples 46. The second locking plate 45 is formed with a protruding push portion 47, so that when the first locking plate 40 is rotated, the second locking plate 45 may be pushed to displace outward relative to the first locking plate 40 by the bosses 42 and the push portion 47.

The first locking plate 40 has a first end protruded with a locking tongue portion 43, and a second end protruded with a retaining portion 41. The second locking plate 45 has an end portion bent with a resting snap portion 48. The locking tongue portion 43 of the first locking plate 40 is vertical to the resting snap portion 48 of the second locking plate 45. The retaining portion 41 of the first locking plate 40 may matingly slide into the retaining recess 16 of the resting block 15 of the operation bar 11. The first locking plate 40 is formed with a drive slot 44 for passage of the guide rod 34 whose displacement may pivot the first locking plate 40.

The drive structure 5 includes a hollow push sleeve 50 mounted on the two pivot housings 30. The push sleeve 50 has an outer periphery formed with a lip 51 which may be matingly locked in an inner side of the locking flange 23 of the wheel housing 20, so that the push sleeve 50 may be pivoted and displaced in the wheel housings 20.

Figure 3:
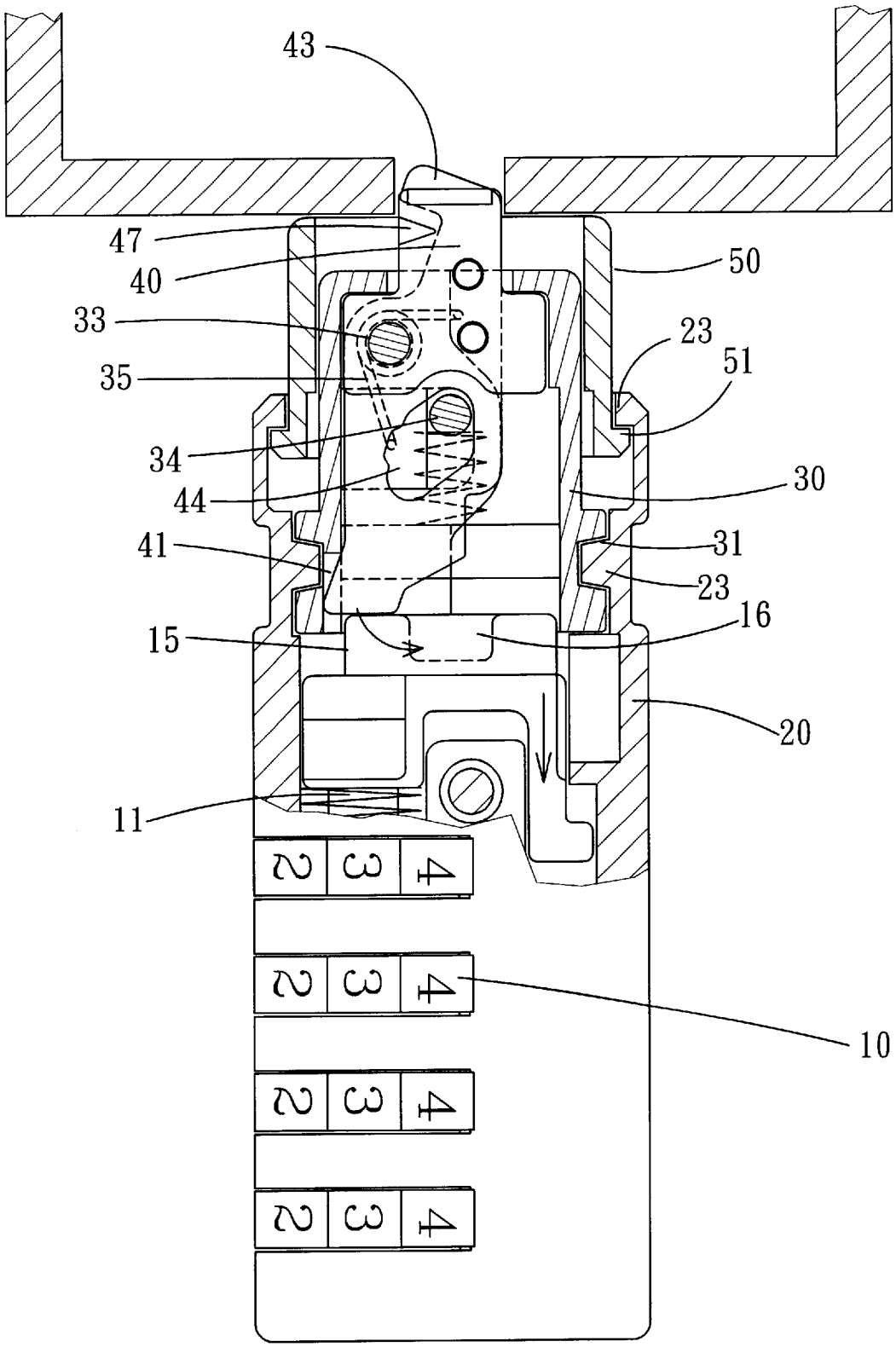
FIG. 3 is a cross-sectional view of the combination lock device as shown in FIG. 2.
Figure 4:
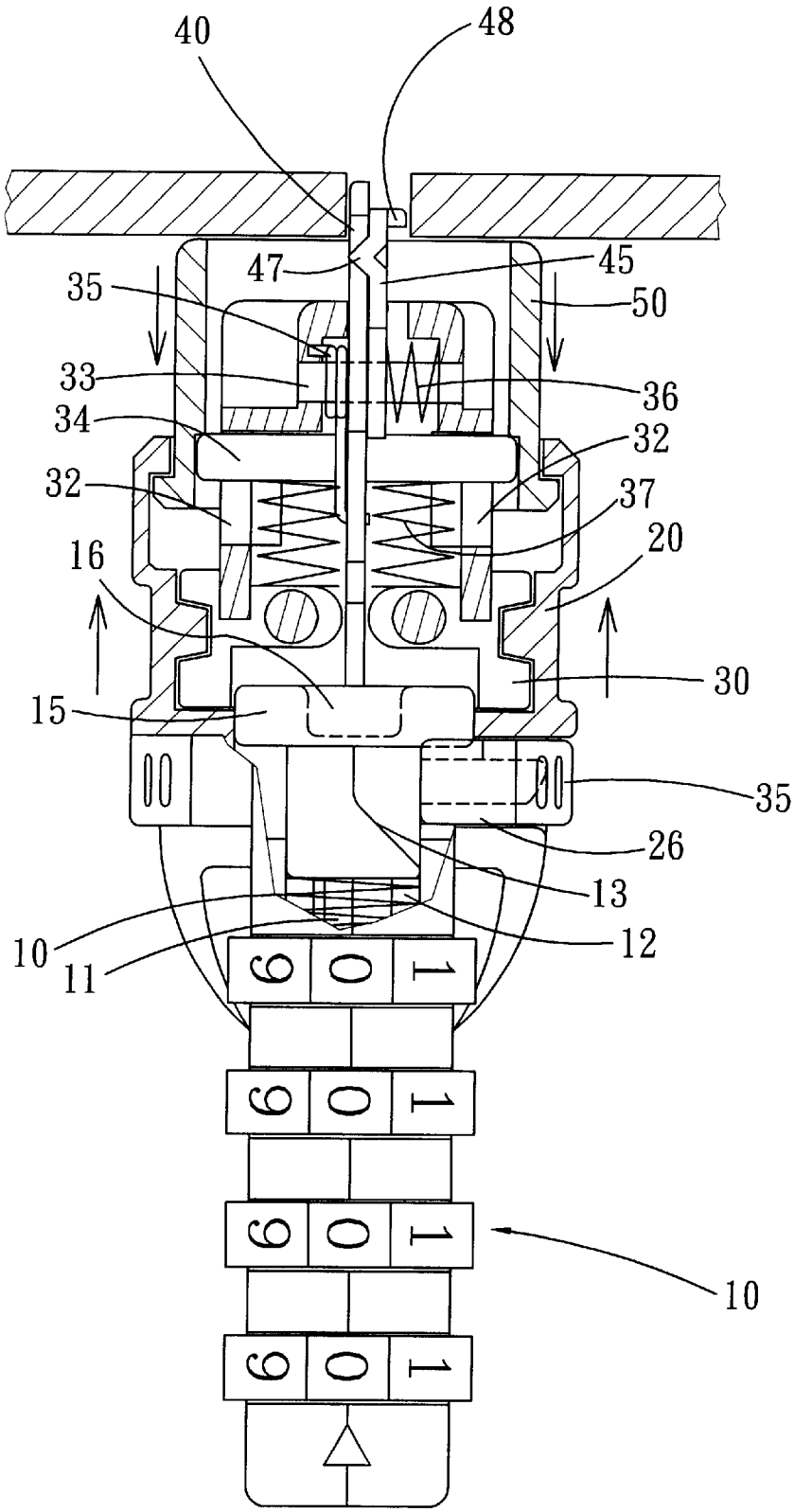
FIG. 4 is a cross-sectional view of the combination lock device as shown in FIG. 2.

Referring to FIGS. 3 and 4, the guide rod 34 is initially pushed by the compression springs 37 to abut the front end of the guide slot 32 of the pivot housing 30 as shown in FIG. 4, and to abut the front end of the drive slot 44 of the first locking plate 40 as shown in FIG. 3. At this time, the retaining portion 41 of the first locking plate 40 is rested on the peripheral end face of the resting block 15 of the operation bar 11 as shown in FIG. 3. At the same time, the bosses 42 of the first locking plate 40 are received in the dimples 46 of the second locking plate 45, while the push portion 47 of the second locking plate 45 is located at the side edge of the locking tongue portion 43 of the first locking plate 40, so that the locking tongue portion 43 of the first locking plate 40 and the resting snap portion 48 of the second locking plate 45 will occupy the minimum space, and can be inserted into the lock hole of the article to be locked.

Figure 5:
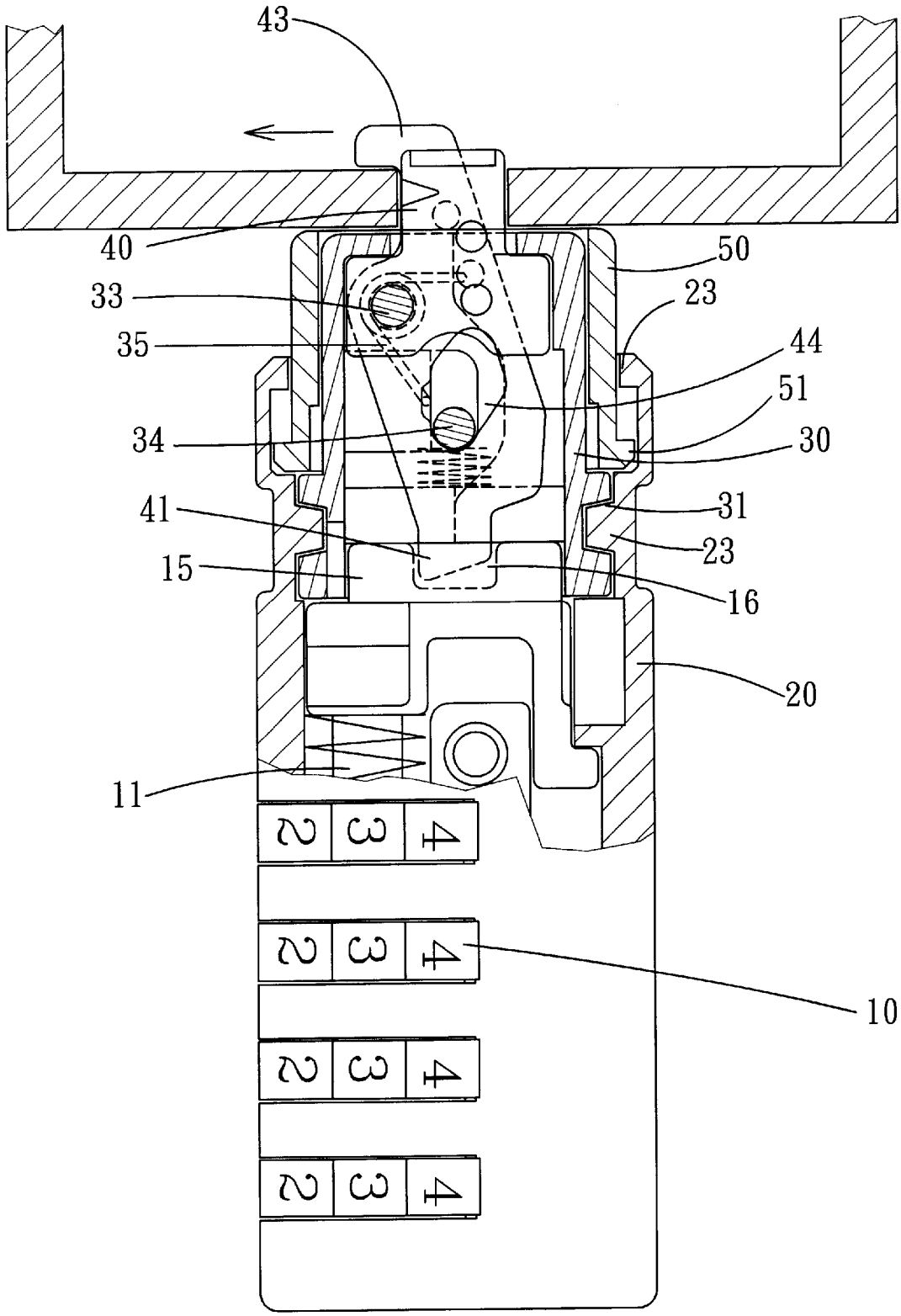
FIG. 5 is a schematic operational view of the combination lock device as shown in FIG. 3.
Figure 6:
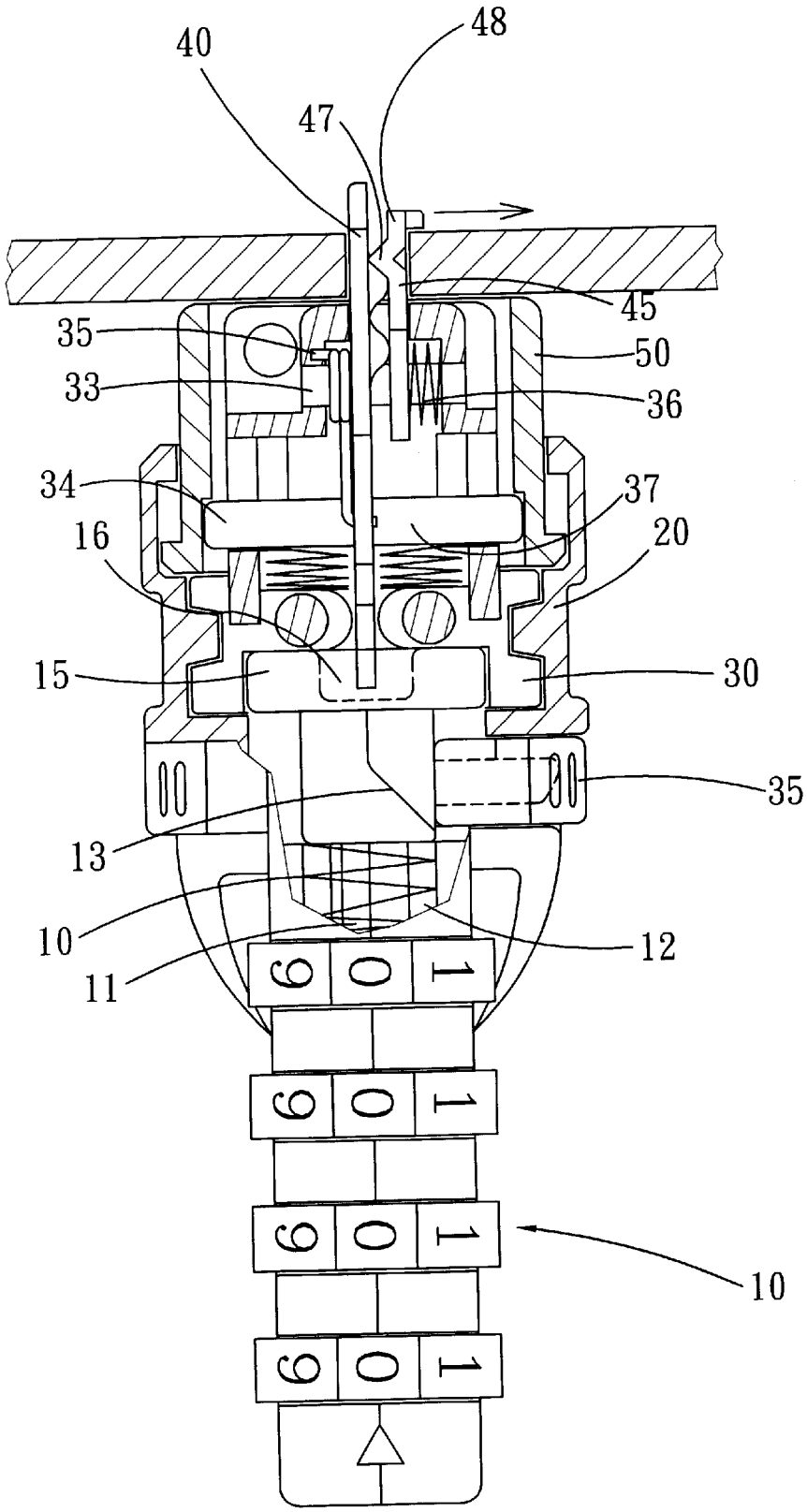
FIG. 6 is a schematic operational view of the combination lock device as shown in FIG. 4.

Referring to FIGS. 5 and 6, the push sleeve 50 of the drive structure 5 is rested on the article to be locked. The user may exert a force on the wheel housing 20, so that the push sleeve 50 of the drive structure 5 is displaced inward, to drive and move the guide rod 34 of the lock snap structure 3. The guide rod 34 is moved in the guide slot 32 of the pivot housing 30 to abut the rear end of the drive slot 44 of the first locking plate 40 as shown in FIG. 5, whereby the first locking plate 40 may be pivoted about the pivot rod 33 through a determined angle, so that the locking tongue portion 43 of the first locking plate 40 may be locked in the wall of the lock hole of the article to be locked. At the same time, the bosses 42 of the first locking plate 40 are detached from the dimples 46 to push the second locking plate 45, while the push portion 47 of the second locking plate 45 pushes the first locking plate 40, whereby the second locking plate 45 is pushed to displace outward relative to the first locking plate 40, so that the resting snap portion 48 of the second locking plate 45 may be locked in the wall of the lock hole of the article to be locked.

By means of pivotal action of the first locking plate 40, the retaining portion 41 of the first locking plate 40 may matingly slide into the retaining recess 16 of the resting block 15 of the operation bar 11, so that the operation bar 11 is moved toward the first locking plate 40 by the restoring force of the restoring spring 12. At this time, if the number wheels of the number wheel structure 10 are rotated to reach the incorrect positions, the operation bar 11 cannot retract inward, so that the combination lock device is locked.

Figure 7:
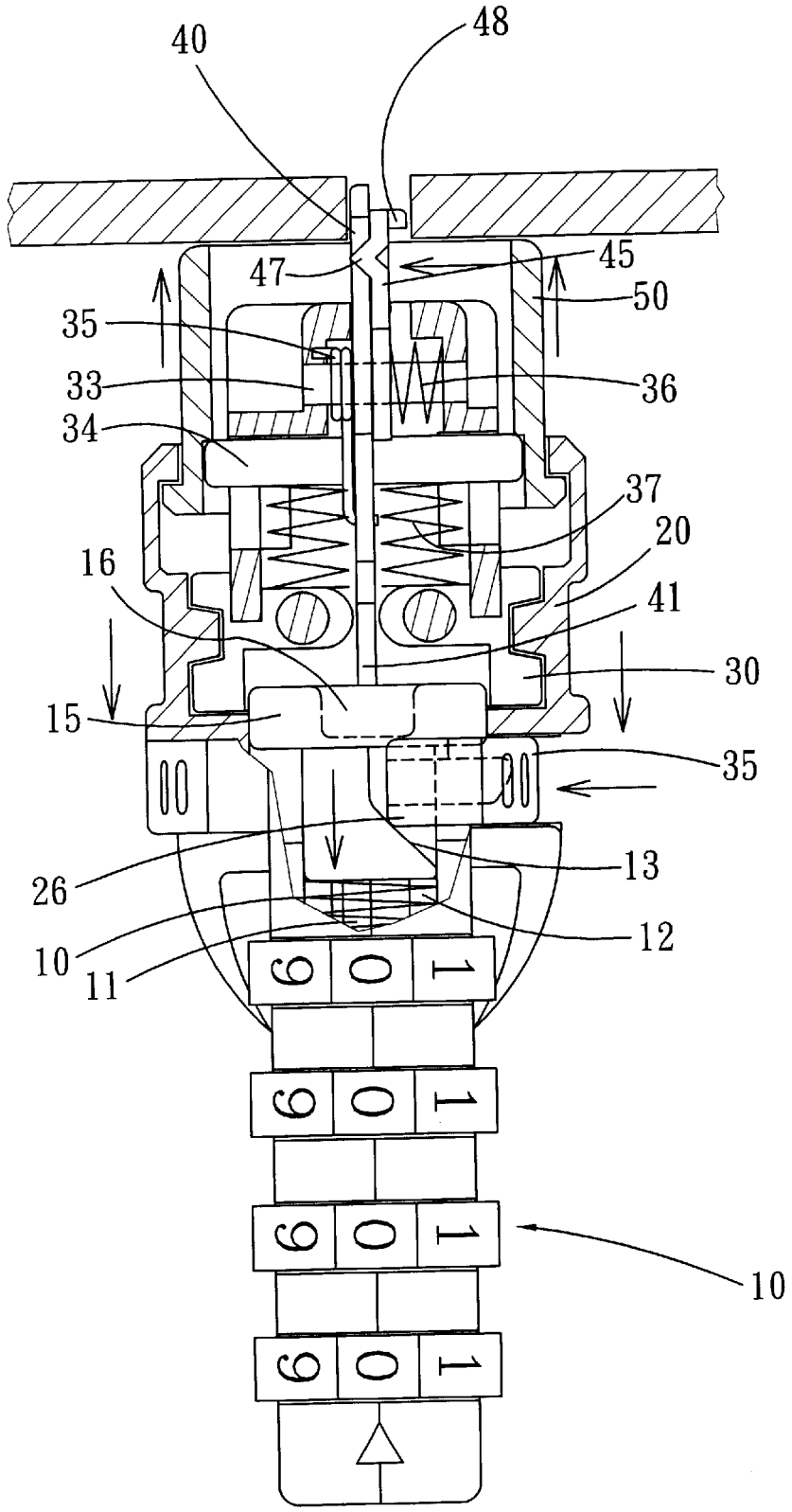
FIG. 7 is a schematic operational view of the combination lock device as shown in FIG. 6.
Figure 8:
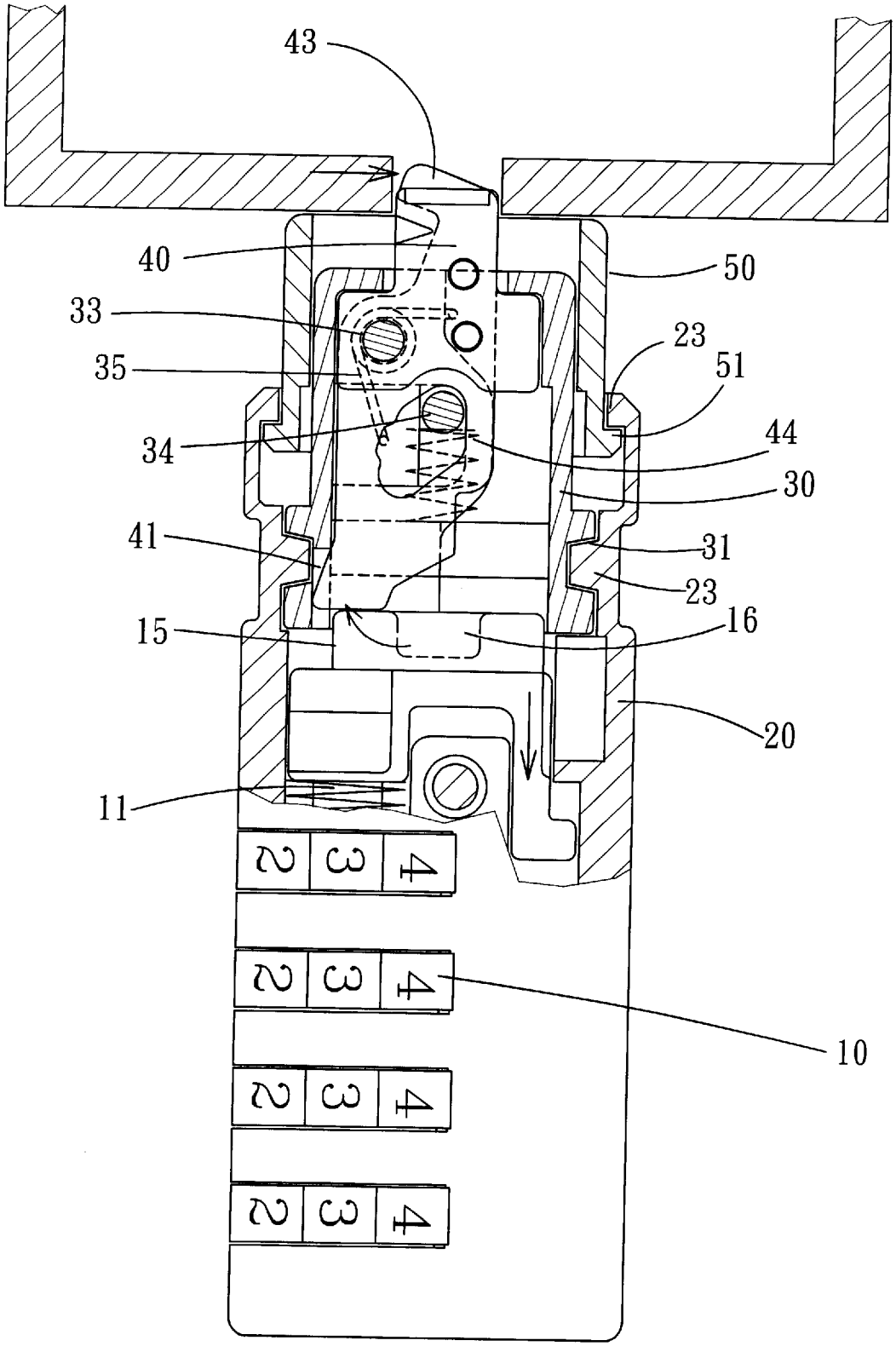
FIG. 8 is a schematic operational view of the combination lock device as shown in FIG. 5.

Referring to FIGS. 7 and 8, when the number wheels of the number wheel structure 10 are rotated to reach the correct positions, the press member 25 may be pressed inward, whereby the arcuate side portion 26 may press the oblique guide block 13 so that the operation bar 11 may be retracted inward, thereby detaching the retaining portion 41 of the first locking plate 40 from the retaining recess 16 of the resting block 15 of the operation bar 11, so that the first locking plate 40 may be returned to its original position by the restoring force of the torsion spring 35, while the guide rod 34 may be returned to its original position by the restoring force of the compression springs 37.

At the same time, when the first locking plate 40 is detached from the push portion 47 of the second locking plate 45, and the bosses 42 of the first locking plate 40 are again inserted into the dimples 46 of the second locking plate 45, the second locking plate 45 may be returned to its original position by the restoring force of the restoring spring 36, so that the locking tongue portion 43 of the first locking plate 40 and the resting snap portion 48 of the second locking plate 45 will again occupy the minimum space, and can be detached from the lock hole of the article to be locked, thereby achieving the unlocking purpose.

It is appreciated that, the pivot housing 30 may be pivoted in the wheel housing 20, so that when the wheel housing 20 is rotated, the pivot housing 30, the first locking plate 40 and the second locking plate 45 will not rotate with the wheel housing 20, thereby preventing the lock hole of the article to be locked from being rotated and broken.

In addition, the user only needs to exert a force on the wheel housing to displace the push sleeve 50 of the drive structure 5 rearward, so that the locking tongue portion 43 of the first locking plate 40 and the resting snap portion 48 of the second locking plate 45 may be respectively locked in the wall of the lock hole of the article to be locked easily, thereby facilitating the user operating the lock device.

Further, when someone unintentionally touches the lock body, the compression springs 37 may provide a cushioning or buffering effect, thereby preventing the lock hole of the article to be locked from being rotated and broken by the first locking plate 40 and the second locking plate 45 due to the person unintentionally touching the lock body.

Figure 9:
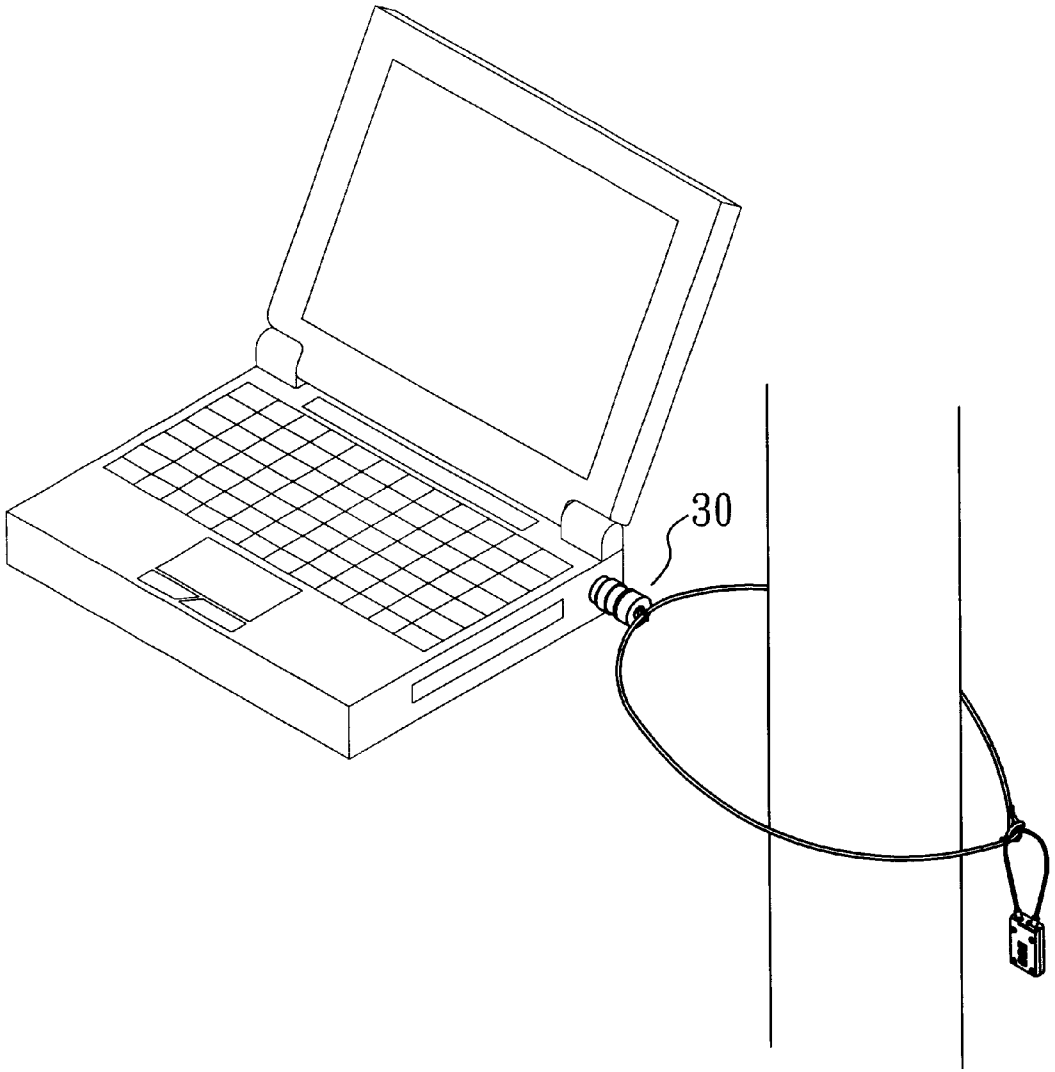
FIG. 9 is a schematic view of the combination lock device in accordance with an embodiment of the present invention.

Referring to FIG. 9, the lock snap structure 3 is snapped in the lock hole. A cable is then passed through the lock snap structure 3. The cable is then locked by a hanging lock.

Accordingly, the combination lock device in accordance with the preferred embodiment of the present invention has the following advantages.

1. The locking tongue portion 43 of the first locking plate 40 is vertical to the resting snap portion 48 of the second locking plate 45, so that the first locking plate 40 and the second locking plate 45 form a locking state with an included angle of ninety degree. Thus, when the lock body is driven by an applied force toward the locking tongue portion 43, the resting snap portion 48 will not provide a support for the applied force, and vice versa, so that the lock hole of the article to be locked cannot be driven and broken.

2. The second locking plate 45 is moved sideward, so that the resting snap portion 48 may provide a larger locking area, thereby enhancing the locking and anti-theft effect.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination lock device, comprising a lock body, a lock snap structure adapted to be locked in a lock hole of an article to be locked, and a drive structure for driving said lock snap structure, wherein:

said lock snap structure includes a carrier, a first locking plate, and a second locking plate, said first locking plate is pivotally mounted in said carrier and may be vertically pivoted by said drive structure, said second locking plate is located beside said first locking plate, and may horizontally slide and displace relative to said first locking plate when said first locking plate is pivoted, said first locking plate has an end portion provided with a locking tongue portion toward a direction of movement thereof, said second locking plate has an end portion provided with a resting snap portion toward a direction of movement thereof, said locking tongue portion is vertical to said resting snap portion.

2. The combination lock device in accordance with claim 1, wherein said carrier is a pivot housing pivotally mounted on said lock body, said pivot housing is formed with an elongated guide slot for passage of a guide rod which is passed through said first locking plate, a pivot rod is passed through said pivot housing for pivoting said first locking plate and said second locking plate, said pivot rod is respectively provided with a torsion spring and a restoring spring on an outside of said first locking plate and said second locking plate, so that said first locking plate may be pivoted to return to an original position by said torsion spring, and said second locking plate can return to an original position by said restoring spring, two compression springs are mounted in said pivot housing and urged on said guide rod for providing a restoring effect, said first locking plate is formed with bosses, and said second locking plate is formed with mating dimples, said second locking plate is formed with a protruding push portion, such that when said first locking plate is rotated, said second locking plate may be pushed to displace outward relative to said first locking plate by said bosses and said push portion.

3. The combination lock device in accordance with claim 1, wherein said lock body is a number lock which includes a number wheel structure, and two wheel housings mounted on said number wheel structure, said number wheel structure includes an operation bar, said operation bar is formed with an oblique guide block, and has a free end formed with a resting block which defines a retaining recess for insertion of a retaining portion of said first locking plate, one wheel housing is formed with a through slot for pivoting a press member which has an arcuate side portion rested on said oblique guide block, so that when said press member is pressed inward, said arcuate side portion may press said oblique guide block so that said operation bar may be retracted inward, each of said two wheel housings has an outer periphery having a front end formed with a corresponding annular pivot groove, for pivoting an annular pivot snap of a cable, each of said two wheel housings has an inner periphery formed with an annular flange mating with an annular groove of each of two pivot housings, and formed with a locking flange for pivoting a mating lip of a push sleeve of said drive structure.

* * * * *